US006675983B1

(12) United States Patent
Álvares et al.

(10) Patent No.: US 6,675,983 B1
(45) Date of Patent: Jan. 13, 2004

(54) CAN FOR PAINT WHITE BASE

(75) Inventors: Antonio Carlos Teixeira Álvares, São Paulo (BR); Antonio Roberto Sene, SãPaulo (BR)

(73) Assignee: Brasilata S.A. Embalagens Metalicas, Sao Paulo (BR)

( * ) Notice: Subject to any disclaimer, the term of this patent is extended or adjusted under 35 U.S.C. 154(b) by 0 days.

(21) Appl. No.: 09/831,807

(22) PCT Filed: Sep. 23, 1999

(86) PCT No.: PCT/BR99/00082

§ 371 (c)(1),
(2), (4) Date: Oct. 15, 2001

(87) PCT Pub. No.: WO00/21840

PCT Pub. Date: Apr. 20, 2000

(30) Foreign Application Priority Data

Oct. 8, 1998 (BR) ..... 9804178

(51) Int. Cl.[7] ..... B65D 51/18; B65D 15/04

(52) U.S. Cl. ..... 220/254; 220/789; 220/FOR 100

(58) Field of Search ..... 220/254.1, 254.2, 220/254.7–254.9, 255, 789, 790, 791, 702, FOR 100, 792, 801, FOR 101, FOR 103

(56) References Cited

U.S. PATENT DOCUMENTS

| | | | | |
|---|---|---|---|---|
| 2,074,231 A | * | 3/1937 | Meacham | 220/789 |
| 3,289,881 A | * | 12/1966 | Ganung | 220/254.1 |
| 3,572,540 A | | 3/1971 | LaCroce | |
| 3,672,547 A | | 6/1972 | Kozlowski | |
| 4,865,233 A | | 9/1989 | Kain | |
| 5,314,061 A | | 5/1994 | Bedrossian | |
| 5,388,715 A | | 2/1995 | Schwindt | |
| 5,899,352 A | * | 5/1999 | Guarda et al. | 220/254.1 |

FOREIGN PATENT DOCUMENTS

GB 2097747 11/1982

* cited by examiner

*Primary Examiner*—Lee Young
*Assistant Examiner*—Lien Ngo
(74) *Attorney, Agent, or Firm*—Darby & Darby

(57) ABSTRACT

A can for paint white base, having a tubular body (10) with the upper edge affixing an annular upper wall portion (11), with the peripheral edge of its discharge opening (12) defining a seat onto which a removable lid (20) is seated, one of the parts defined by the upper wall portion (11) and the removable lid (20) being provided with an inspection opening (22) with a cross section substantially smaller than that of said discharge opening (12) and with its peripheral edge defining a seat for receiving and axially retaining a respective auxiliary lid (20), which is removable and constructed in a transparent material.

6 Claims, 3 Drawing Sheets

CAN FOR PAINT WHITE BASE

This is a U.S. national phase application under 35 U.S.C. §371 of International Patent Application No. PCT/BR99/00082 filed on Sep. 23, 1999 and claims the benefit of Brazilian Application No. PI 98045178-9 filed on Oct. 8, 1998. The International Application was published in English on Apr. 20, 2000 as International Publication No. WO 00/21840 under PCT Article 21(2).

FIELD OF THE INVENTION

The present invention refers to a can obtained in a metallic sheet and of the type comprising a tubular body, with the lower edge affixing a bottom wall and with the upper edge affixing an annular upper wall portion, which may take the form of a structural ring and whose inner peripheral edge defines a seat for receiving and retaining a press fittable lid. Particularly, the invention relates to the provision of a can of the type mentioned above and used to contain the paint white base, which may receive pigments for colour adjustments at the time of purchase by the final user.

BACKGROUND OF THE INVENTION

It has been increasingly more common the commercialization of paints, which may be water or oil based, in the basic white colour, the achievement of the colour desired by the final user being obtained by blending, either manually or mechanically, pigments which are calculated to impart the desired colour to the amount of white base contained in the can.

According to this system of commercialization, when the user is acquiring the paint, the can containing an amount of white base received from the paint manufacturer has its lid opened for the introduction of pigments and subsequently closed to allow said can to be agitated, aiming at obtaining the homogenization of the blend, as well as the the desired colour of the paint. In other systems, the blend of the white base with the pigments is made by means of a mixing-agitating device, which is introduced inside the can through the opening onto which said lid is seated and which remains opened during this operation.

In the first case, once the agitation operation with the reclosed lid has finished, the latter has to be reopened, in order to allow the visual inspection of the blended paint, said lid then being reclosed so that the can may be transported by the consumer. This procedure, however, has several inconveniences. The opening operations before the pigmentation and after the agitation operation are carried out with the lid carrying, inferiorly, a certain amount of paint which, as a function of the dimensions of said lids, is sufficient to cause splashes, being practically impossible to avoid the damage caused by dirt in the operation area. Moreover, the opening and closing operations of said lids are rather complex and take a long time due to their diameters, particularly the 18 liter and 1 gallon cans, making difficult and extending the pigmentation process at the time the paint is purchased by the final consumer.

Even in the cases in which mixing the pigments and the white base is carried out with the lid in the opened condition, spreading the paint is not avoided with the movement of the can, neither are avoided the opening and closing operations, which are only reduced to half, since the inspection is made with the can still open. Also in these cases, the exposure of the amount of white base through the large upper opening of the can facilitates the contact thereof with the external environment during the agitation operation, allowing a certain undesirable degree of exposition of the paint contained in the can, as well as splashes of the paint on the upper wall of the can.

DISCLOSURE OF THE INVENTION

The objective of the present invention is to provide a can of the type considered herein and which may have its content of paint white base selectively pigmented at the time of purchase by the final user, through a fast and simple procedure which minimizes the production of dirt caused by splashes of paint in the environment, as well as the exposure of the paint to the outside environment, allowing the easy visual inspection of the amount of the pigmented and homogenized paint.

The objective above is achieved by providing a metallic can of tubular body, with the upper edge affixing an annular upper wall portion, with the peripheral edge of its discharge opening defining a seat onto which a removable lid is seated.

According to the invention, one of the parts defined by the upper wall portion and by the removable lid is provided with an inspection opening, with a cross section substantially smaller than that of said said discharge opening and with its peripheral wall defining a seat for receiving and axially retaining a respective auxiliary lid, which is also removable and constructed in a transparent material.

The construction defined above allows that the inside of the can, having an amount of paint white base, be accessed upon easily and quickly removing the auxiliary lid, making possible to apply a pigment shower to said amount of white base.

After the application of the pigment, the auxiliary lid in transparent material may be closed again, in order to permit the agitation of the can to homogenize the pigmented paint, the visual inspection of which may be made by the consumer through the transparent auxiliary lid itself, with no need of removing said lid.

In the cases in which the blend is carried out by a mixing-agitating device, the latter is introduced inside the can through the inspection opening, which is only closed by the auxiliary lid after the homogenization has finished.

In both procedures, the opening of the auxiliary lid, whose diameter is much smaller than that of the removable lid, minimizes the risk of splashes of paint which spoil the environment in which the pigmentation is carried out.

According to another aspect of the present invention, the discharge opening and the inspection opening are provided with violation evidencing means, when said violation occurs by the undue opening of either of the lids thereof.

BRIEF DESCRIPTION OF THE DRAWINGS

The invention will be described below, with reference to the attached drawings, in which.

DESCRIPTION OF THE ILLUSTRATED EMBODIMENTS

Figure 1:
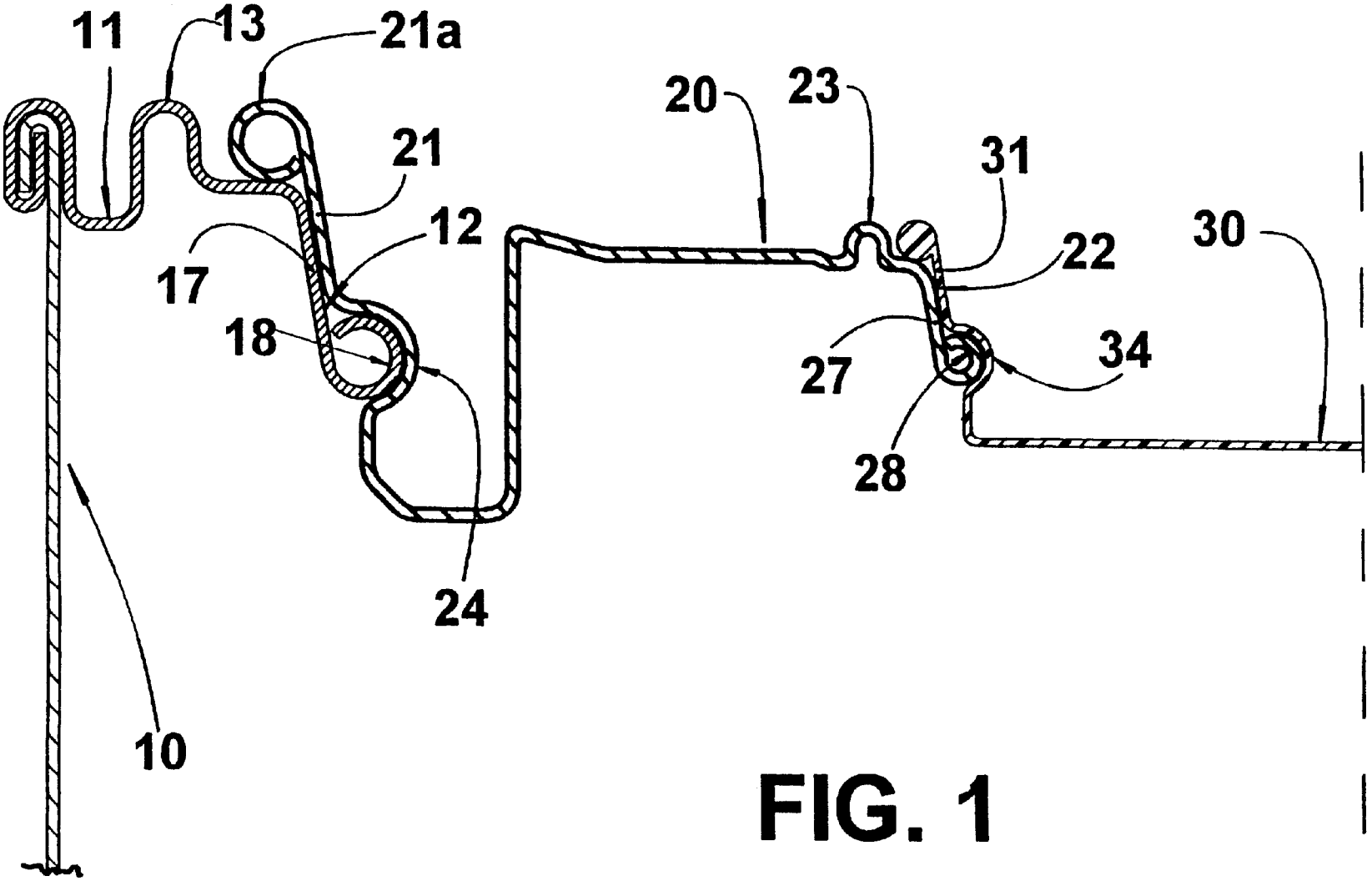
FIG. 1 is a top plan view of a can having an upper wall as an structural ring constructed according to the present invention and having the auxiliary lid removably fitted in an inspection opening provided in the middle of there movable lid itself.
Figure 2:
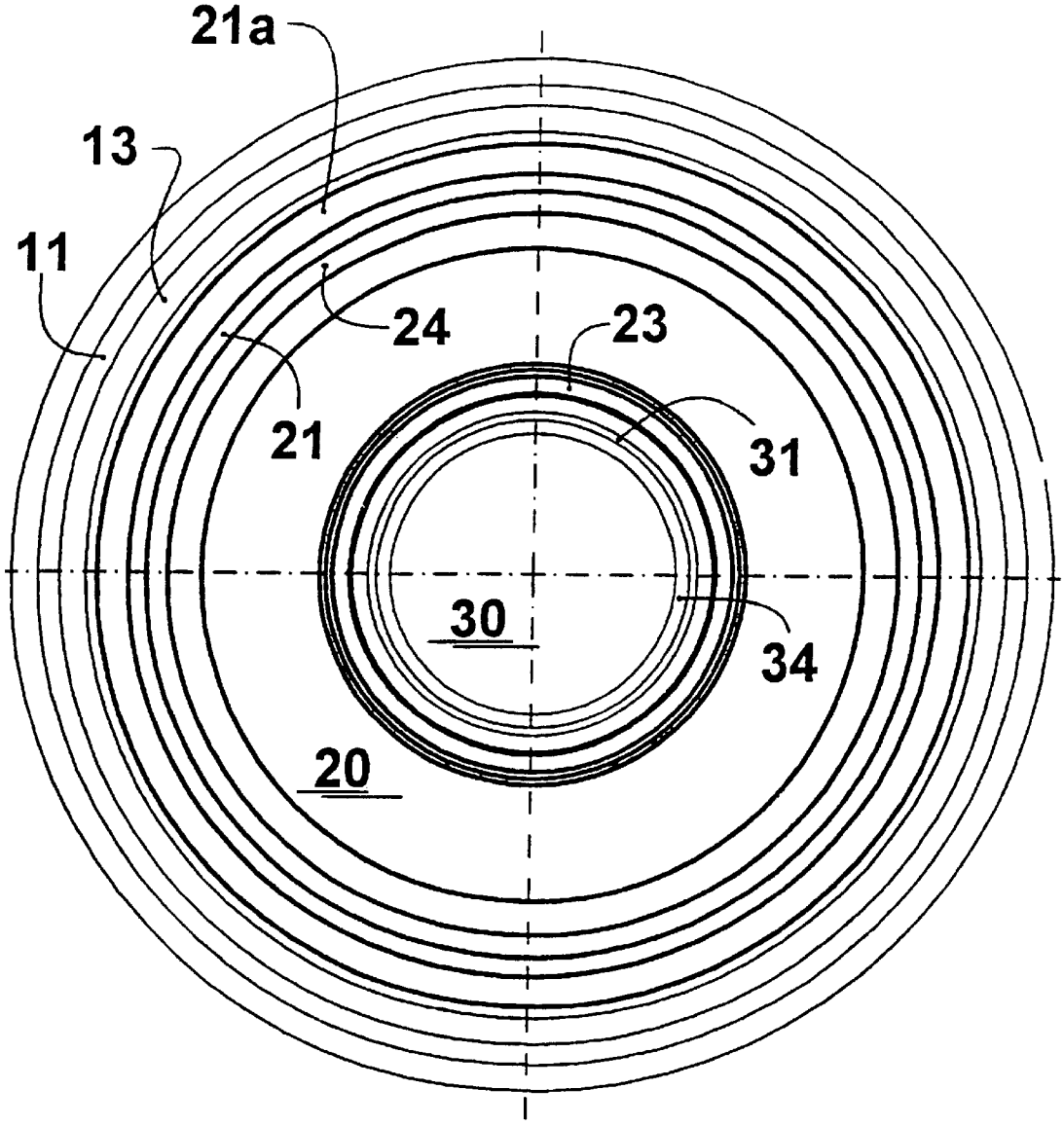
FIG. 2 is a partial diametral cross-sectional view of the can illustrated in FIG. 1.
Figure 3:
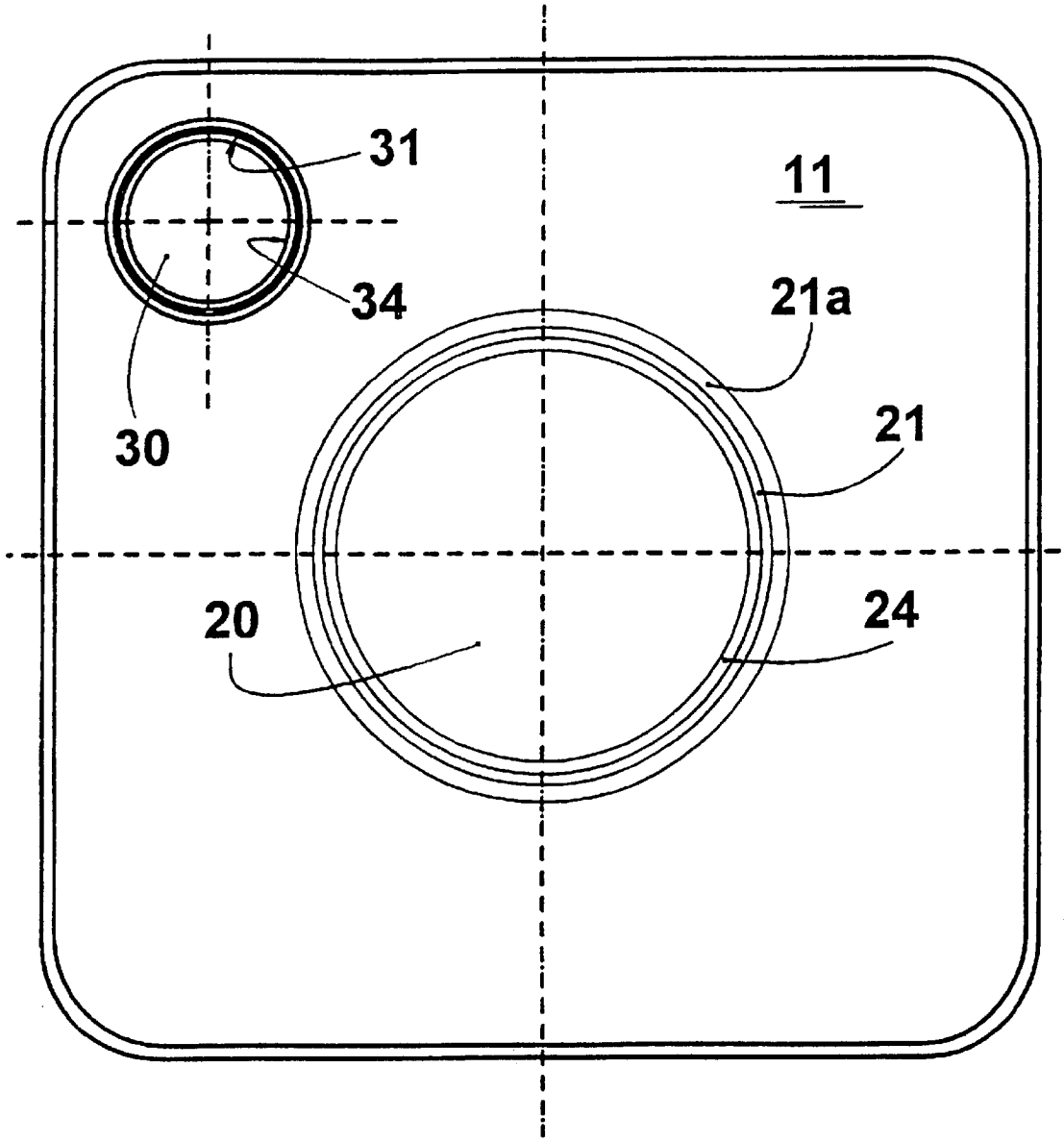
FIG. 3 is an upper plan view of a can having a large annular upper wall surrounding the removable lid and having an inspection opening placed in an eccentric position in relation to the vertical axis of the can and being reclosable by a removable auxiliary lid.

According to the drawings, the invention refers to a can made of a metallic sheet, having a tubular body 10 with the lower edge affixing a bottom wall (not illustrated) and with the upper edge affixing, usually by double seaming, an annular upper wall 11 which may take the form of a structural ring, as illustrated in FIGS. 1 and 2, or of an annular plate in the larger cans, such as the 18 liter can illustrated in FIG. 3.

In both constructions of the upper wall 11, the latter is provided with a discharge opening 12 which defines a first seat for receiving and retaining a removable lid 20. In the illustrated construction, the first seat is constructed according to the solution described and claimed in U.S. Pat. No. 5,899,352 of the same applicant, in which the discharge opening 12 incorporates a depending skirt 17 carrying a circumferential internal rib 18, which is fittable, in the can closed condition, into a corresponding circumferential recess 24 provided in a peripheral wall 21 of the lid 20.

As already discussed in said U.S. prior patent, this construction of lid fitting allows to obtain excellent results in terms of sealing and axial retention of the lid, without impairing the closing and opening operations. According to this prior construction of the same applicant, the upper wall 11 may be also provided with a circumferential projection 13, disposed adjacent to the position of the flanged upper edge 21*a* of the lid 20 in a seated position, so as to function as a compulsory supporting means for a blade or stem of a lever used to open the can, said circumferential projection 13 being deformed by said tool, in such a way as to become a violation evidencing means of the can.

However, it should be understood that the invention may be applied to cans, whose removable lid is fitted and retained by those retaining means conventionally used for many years.

According to a first way of carrying out the invention, the removable lid 20 is provided with an inspection opening 22, incorporating a depending skirt 27 carrying an internal circumferential rib 28, which is fittable into a corresponding circumferential recess 34 provided in a peripheral lateral wall 31 of an auxiliary lid 30, in a constructive arrangement which is preferably identical to that applied to the removable lid 20, except for the diameter of the auxiliary lid 30 which is substantially smaller than that of the removable lid 20 and which is dimensioned in a value sufficient to allow the introduction of the pigments and, optionally, of the mixing-agitating means inside the can.

As mentioned before, the auxiliary lid 30 is constructed in a transparent plastic material, in order to allow the visualization of the content of the can, with no need of opening said can, and it is preferably associated with a violation evidencing means 23, such as that provided for the removable lid 20.

According to the embodiment of FIG. 3, the inspection opening may take the form of a second opening, with smaller dimensions than those of the discharge opening 12, but constructed with the same basic characteristics of the latter, in order to receive and retain a respective auxiliary lid 30, which is also removable and made of a transparent material.

What is claimed is:

1. A can for paint white base, comprising:

a tubular body with an annular upper wall portion affixed to an upper edge of the tubular body, the upper wall terminating at a peripheral edge defining a discharge opening a removable lid engaging said peripheral edge, said removable lid further having an inspection edge comprising a substantially vertical downwardly extending skirt, a lower section of said skirt forming a circumferential rib, wherein said inspection edge defines an inspection opening having a cross section substantially smaller than that of said discharge opening; and an auxiliary lid constructed of a transparent material, the auxiliary lid having an end portion engaging said removable lid inspection edge, wherein said auxiliary lid end portion comprises a substantially vertical lateral wall portion and a recessed wall portion, and wherein said recessed portion engages said removable lid circumferential rib and wherein said lateral wall portion engages said removable lid skirt.

2. The can of claim 1, wherein auxiliary lid is plastic.

3. A can for white base paint comprising:

a tubular body having a vertical wall with a top end and a bottom end disposed at opposite ends thereof, and an upper wall portion connected to said vertical wall top end, extending inwardly therefrom and terminating at a peripheral edge defining a discharge opening having a particular cross section;

a removable lid having an end portion engaging said upper wall peripheral edge to cover said discharge opening, said removable lid further having an inspection edge comprising a substantially vertical downwardly extending skirt, a lower section of said skirt forming a circumferential rib, wherein said inspection edge defines an inspection opening having a cross section substantially smaller than said discharge opening cross section; and a removable auxiliary lid constructed of a transparent material and having an auxiliary lid end portion engaging said removable lid inspection edge to cover said inspection opening, wherein said auxiliary lid end portion has a substantially vertical lateral wall portion and a recessed wall portion, and wherein said recessed portion engages said removable lid circumferential rib and wherein said lateral wall portion engages said removable lid skirt.

4. The can of claim 3, wherein said auxiliary lid is plastic.

5. The can of claim 3, wherein said removable lid further comprises a circumferential projecting portion.

6. The can of claim 3, wherein said auxiliary lid end portion further comprises a circumferential rib.

* * * * *